US005917311A

United States Patent [19]

Brokaw

[11] Patent Number: 5,917,311

[45] Date of Patent: Jun. 29, 1999

[54] TRIMMABLE VOLTAGE REGULATOR FEEDBACK NETWORK

[75] Inventor: A. Paul Brokaw, Burlington, Mass.

[73] Assignee: Analog Devices, Inc., Norwood, Mass.

[21] Appl. No.: 09/027,613

[22] Filed: Feb. 23, 1998

[51] Int. Cl.[6] ..... G05F 1/575

[52] U.S. Cl. ..... 323/280; 323/316; 323/907

[58] Field of Search ..... 323/273, 274, 323/280, 281, 312, 313, 314, 315, 316, 907

[56] References Cited

U.S. PATENT DOCUMENTS

| | | | |
|---|---|---|---|
| 4,636,710 | 1/1987 | Stanojevic | 323/280 |
| 4,665,356 | 5/1987 | Pease | 323/314 |
| 5,252,908 | 10/1993 | Brokaw | 323/313 |

*Primary Examiner*—Robert E. Nappi
*Assistant Examiner*—Y. J. Han
*Attorney, Agent, or Firm*—Koppel & Jacobs

[57] ABSTRACT

A trimmable voltage regulator feedback network is arranged as a voltage divider: series-connected resistors are connected between the divider tap and the regulator's output voltage and a fixed resistance is connected between the tap and ground. Severable links are connected across at least two resistors above the tap to allow the regulator output voltage to be trimmed in linearly independent increments with each severed link, thereby simplifying the task of determining which links to sever to attain a desired output voltage. A trimmable resistance is inserted between the divider tap and the circuit being driven to enable the impedance of the network to be adjusted. A regulator including the novel feedback network can provide a temperature-compensated output over the full range of selectable output voltages.

23 Claims, 4 Drawing Sheets

| $V_{out}$(volts) | L9 | L8 | L7 | L6 | L5 | L4 | $V_{out}$(volts) | L9 | L8 | L7 | L6 | L5 | L4 |
|---|---|---|---|---|---|---|---|---|---|---|---|---|---|
| 2.10 | 0 | 0 | 0 | 0 | 0 | 0 | 3.70 | 1 | 0 | 0 | 0 | 0 | 0 |
| 2.15 | 0 | 0 | 0 | 0 | 0 | 1 | 3.75 | 1 | 0 | 0 | 0 | 0 | 1 |
| 2.20 | 0 | 0 | 0 | 0 | 1 | 0 | 3.80 | 1 | 0 | 0 | 0 | 1 | 0 |
| 2.25 | 0 | 0 | 0 | 0 | 1 | 1 | 3.85 | 1 | 0 | 0 | 0 | 1 | 1 |
| 2.30 | 0 | 0 | 0 | 1 | 0 | 0 | 3.90 | 1 | 0 | 0 | 1 | 0 | 0 |
| 2.35 | 0 | 0 | 0 | 1 | 0 | 1 | 3.95 | 1 | 0 | 0 | 1 | 0 | 1 |
| 2.40 | 0 | 0 | 0 | 1 | 1 | 0 | 4.00 | 1 | 0 | 0 | 1 | 1 | 0 |
| 2.45 | 0 | 0 | 0 | 1 | 1 | 1 | 4.05 | 1 | 0 | 0 | 1 | 1 | 1 |
| 2.50 | 0 | 0 | 1 | 0 | 0 | 0 | 4.10 | 1 | 0 | 1 | 0 | 0 | 0 |
| 2.55 | 0 | 0 | 1 | 0 | 0 | 1 | 4.15 | 1 | 0 | 1 | 0 | 0 | 1 |
| 2.60 | 0 | 0 | 1 | 0 | 1 | 0 | 4.20 | 1 | 0 | 1 | 0 | 1 | 0 |
| 2.65 | 0 | 0 | 1 | 0 | 1 | 1 | 4.25 | 1 | 0 | 1 | 0 | 1 | 1 |
| 2.70 | 0 | 0 | 1 | 1 | 0 | 0 | 4.30 | 1 | 0 | 1 | 1 | 0 | 0 |
| 2.75 | 0 | 0 | 1 | 1 | 0 | 1 | 4.35 | 1 | 0 | 1 | 1 | 0 | 1 |
| 2.80 | 0 | 0 | 1 | 1 | 1 | 0 | 4.40 | 1 | 0 | 1 | 1 | 1 | 0 |
| 2.85 | 0 | 0 | 1 | 1 | 1 | 1 | 4.45 | 1 | 0 | 1 | 1 | 1 | 1 |
| 2.90 | 0 | 1 | 0 | 0 | 0 | 0 | 4.50 | 1 | 1 | 0 | 0 | 0 | 0 |
| 2.95 | 0 | 1 | 0 | 0 | 0 | 1 | 4.55 | 1 | 1 | 0 | 0 | 0 | 1 |
| 3.00 | 0 | 1 | 0 | 0 | 1 | 0 | 4.60 | 1 | 1 | 0 | 0 | 1 | 0 |
| 3.05 | 0 | 1 | 0 | 0 | 1 | 1 | 4.65 | 1 | 1 | 0 | 0 | 1 | 1 |
| 3.10 | 0 | 1 | 0 | 1 | 0 | 0 | 4.70 | 1 | 1 | 0 | 1 | 0 | 0 |
| 3.15 | 0 | 1 | 0 | 1 | 0 | 1 | 4.75 | 1 | 1 | 0 | 1 | 0 | 1 |
| 3.20 | 0 | 1 | 0 | 1 | 1 | 0 | 4.80 | 1 | 1 | 0 | 1 | 1 | 0 |
| 3.25 | 0 | 1 | 0 | 1 | 1 | 1 | 4.85 | 1 | 1 | 0 | 1 | 1 | 1 |
| 3.30 | 0 | 1 | 1 | 0 | 0 | 0 | 4.90 | 1 | 1 | 1 | 0 | 0 | 0 |
| 3.35 | 0 | 1 | 1 | 0 | 0 | 1 | 4.95 | 1 | 1 | 1 | 0 | 0 | 1 |
| 3.40 | 0 | 1 | 1 | 0 | 1 | 0 | 5.00 | 1 | 1 | 1 | 0 | 1 | 0 |
| 3.45 | 0 | 1 | 1 | 0 | 1 | 1 | 5.05 | 1 | 1 | 1 | 0 | 1 | 1 |
| 3.50 | 0 | 1 | 1 | 1 | 0 | 0 | 5.10 | 1 | 1 | 1 | 1 | 0 | 0 |
| 3.55 | 0 | 1 | 1 | 1 | 0 | 1 | 5.15 | 1 | 1 | 1 | 1 | 0 | 1 |
| 3.60 | 0 | 1 | 1 | 1 | 1 | 0 | 5.20 | 1 | 1 | 1 | 1 | 1 | 0 |
| 3.65 | 0 | 1 | 1 | 1 | 1 | 1 | 5.25 | 1 | 1 | 1 | 1 | 1 | 1 |

FIG.5

TRIMMABLE VOLTAGE REGULATOR FEEDBACK NETWORK

BACKGROUND OF THE INVENTION

1. Field of the Invention

This invention relates to the field of voltage regulators, and particularly to trimmable resistive networks used in the feedback loop of a voltage regulator to establish its output voltage.

2. Description of the Related Art

A conventional series pass voltage regulator is shown in FIG. 1. A supply voltage $V_{in}$ is connected to the collector 10 of a pass transistor 12, typically a bipolar transistor, and an output voltage $V_{out}$ is taken at the transistor's emitter 14. The output voltage is regulated by controlling pass transistor 12 via its base terminal 16. Regulation is accomplished with a feedback loop: the output voltage is fed back to the inverting input 18 of an error amplifier 20, usually after being divided down with a voltage divider 22. A voltage reference $V_{ref}$ is connected to the non-inverting input 24 of the amplifier. In operation, the amplifier's output 26 drives pass transistor 12 as needed to make the voltage at its inverting and non-inverting inputs equal. By dividing down $V_{out}$, the voltage divider 22 enables the regulator to produce an output voltage $V_{out}$ that is greater than the reference voltage $V_{ref}$.

It is occasionally desirable to manufacture a voltage regulator which is capable of producing a number of different output voltages without changing any components or component values, with the desired output voltage selected during fabrication with a trimming step. In the regulator of FIG. 1, this capability is provided with the use of trimmable voltage divider 22. Divider 22 is made from four series-connected resistors Ra-Rd, each of which has a respectivey "severable link" La-Ld connected across it; the four resistors are connected between the regulator output voltage $V_{out}$ and a fixed voltage which is typically ground. The divider produces a feedback voltage $V_{fb}$ at a divider tap point 28. The links are severable with a laser, with the aforementioned trimming step used to sever the links as necessary to produce a desired output voltage.

To date, the trimmable voltage dividers found in regulator feedback loops have been arranged as shown in FIG. 1—i.e., with trimmable resistances provided on both sides of divider tap 28. This configuration affords several advantages: a number of division ratios $2^n$ is made possible, with n being the number of links in the divider. Further, because the trimmability is distributed on either side of tap 28, the change in impedance seen by amplifier 20 over the range of attainable division ratios is kept small.

However, the standard trimmable divider configuration shown in FIG. 1 also has disadvantages. Because there are severable links on either side of the divider tap, the effect on output voltage had by severing the links above the tap ("upper links") is dependent on the status of the links below the tap ("lower links"). Severing more of the lower links increases the net resistance below the tap, which decreases the effect on $V_{out}$ of severing upper links. Also, while output voltage increases as upper links are severed, it decreases as lower links are severed. These various and contradictory effects on output voltage resulting from the placement of links on either side of the divider tap make the determination of the link configuration needed to produce a desired output voltage confusing and difficult.

Another disadvantage inherent in resistive networks of the type shown in FIG. 1 is the limited range of obtainable output voltages. Because links on opposite sides of the tap can reduce a given link's effect, the range of obtainable output voltages as the number of severed links goes from few to many is limited.

SUMMARY OF THE INVENTION

A trimmable voltage regulator feedback network is presented that overcomes the disadvantages of prior art networks discussed above. The links and fixed resistances are arranged to simplify the acquisition of a desired output voltage, while providing the greatest possible range of output voltages as the number of severed links increases.

The novel network structure places all of its severable links above the tap, i.e., between the divider tap and the regulator output voltage, with only a fixed resistance between the tap and ground. This has at least two advantages: first, it allows the regulator output voltage to increase linearly with each severed link. Increments in output voltage accumulate linearly, making the determination of which links to cut to attain a desired output voltage very straightforward. Secondly, it provides the greatest possible range of output voltages as the number of links which are severed goes from zero to all.

The novel network also provides a greater range of equivalent resistances at the divider tap, which may adversely affect the circuit which receives the feedback voltage. To compensate for this larger range of resistances, a trimmable resistance can be inserted between the divider tap and the circuit being driven, which is then trimmed at the same time that the network's links are severed.

The voltage regulator feedback network can be configured, by severing links as appropriate, to generate a feedback voltage equal to the regulator's reference voltage—often the bandgap voltage of silicon—when a desired output voltage is present. The network can also be arranged to produce a feedback voltage appropriate for a "virtual reference" arrangement, in which the reference voltage does not explicitly appear at any circuit node in the regulator, while still providing a temperature-compensated regulator output voltage.

Further features and advantages of the invention will be apparent to those skilled in the art from the following detailed description, taken together with the accompanying drawings.

BRIEF DESCRIPTION OF THE DRAWINGS

FIG. 5 is a table of obtainable regulator output voltages for the regulator shown in FIG. 4.

DETAILED DESCRIPTION OF THE INVENTION

Figure 1:
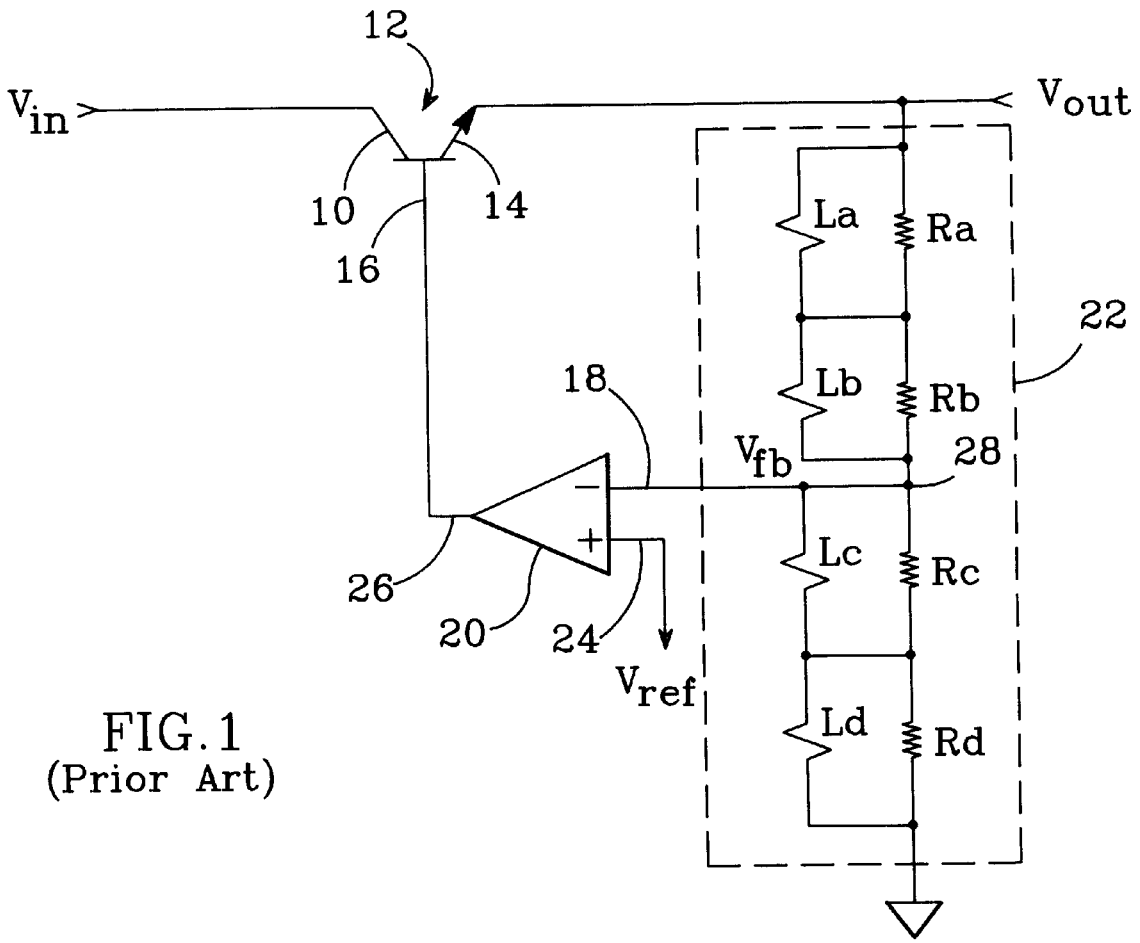
FIG. 1 (Prior Art)
FIG. 1 is a schematic diagram of a prior art series pass voltage regulator.
Figure 2:
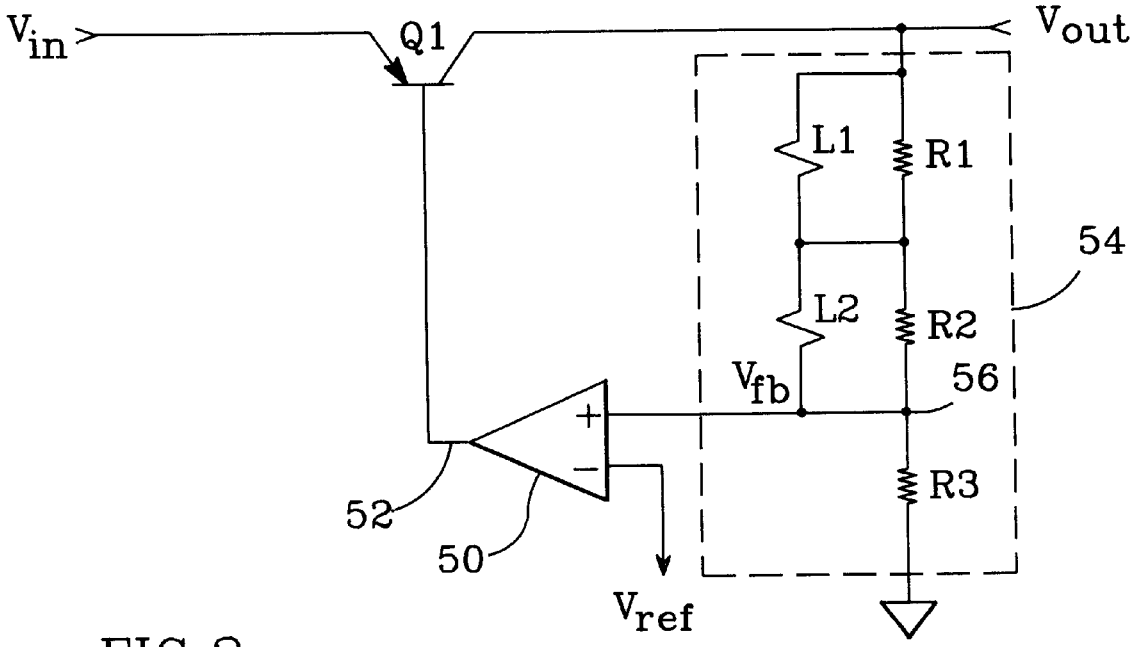
FIG. 2 is a schematic diagram of a series pass voltage regulator using a trimmable feedback network per the present invention.

A schematic diagram of voltage regulator incorporating the new trimmable feedback network is shown in FIG. 2. An amplifier 50 receives a reference voltage $V_{ref}$ at its inverting terminal and a feedback voltage $V_{fb}$ at its non-inverting terminal. The amplifier's output 52 is connected to drive the regulator's pass transistor Q1, implemented in FIG. 2 as a pnp bipolar transistor, though the present invention is useful with pass transistors of any type or polarity. The regulator produces an output voltage $V_{out}$ from which $V_{fb}$ is derived. If $V_{fb}$ is greater than $V_{ref}$, the amplifier output 52 swings positive, reducing the drive to Q1 and causing $V_{out}$ to fall; amplifier output 52 swings negative when $V_{fb\ less\ than\ Vref}$. In this way, amplifier 50 produces the output necessary to make its two inputs equal and thereby regulate $V_{out}$.

$V_{fb}$ is derived from $V_{out}$ by means of a resistive feedback network 54 which includes two series-connected resistors R1 and R2 connected between $V_{out}$ and a divider tap point 56, and a resistor R3 connected between tap 56 and a fixed voltage which is typically ground. The feedback network 54 is made trimmable by connecting a severable link across each of the resistors located above tap 56; links L1 and L2 are across resistors R1 and R2, respectively. When a link is severed its respective resistor is inserted into the network, while an unsevered link acts as a short around its respective resistor. Assuming that L1 is severed and L2 is not, the network 54 establishes a fixed proportionality between $V_{out}$ and $V_{fb}$ which is given by:

$$V_{out}/V_{fb}=(R1+R3)/R3=R1/R3+1 \quad \text{(Eq. 1)}$$

If L2 is severed and L1 is not, the proportionality is given by:

$$V_{out}/V_{fb}=(R2+R3)/R3=R2/R3+1 \quad \text{(Eq. 2)}$$

If both L1 and L2 are severed, the proportionality is given by:

$$V_{out}/V_{fb}=(R1+R2+R3)/R3=(R1+R2)/R3+1 \quad \text{(Eq. 3)}$$

From equations 1–3 it is seen that output voltage $V_{out}$ is directly proportional to the total resistance above the tap 56, and that $V_{out}$ increases linearly as each link is severed. Because $V_{out}$ accumulates linearly with each severed link, the task of determining which links to sever to obtain a desired $V_{out}$ is greatly simplified over the prior art. The linear accumulation of output voltage increments is insured by requiring that all of the network's severable links be across resistors located above the tap 56. At least two such links are required above the tap to obtain the benefits of this configuration.

Figure 3:
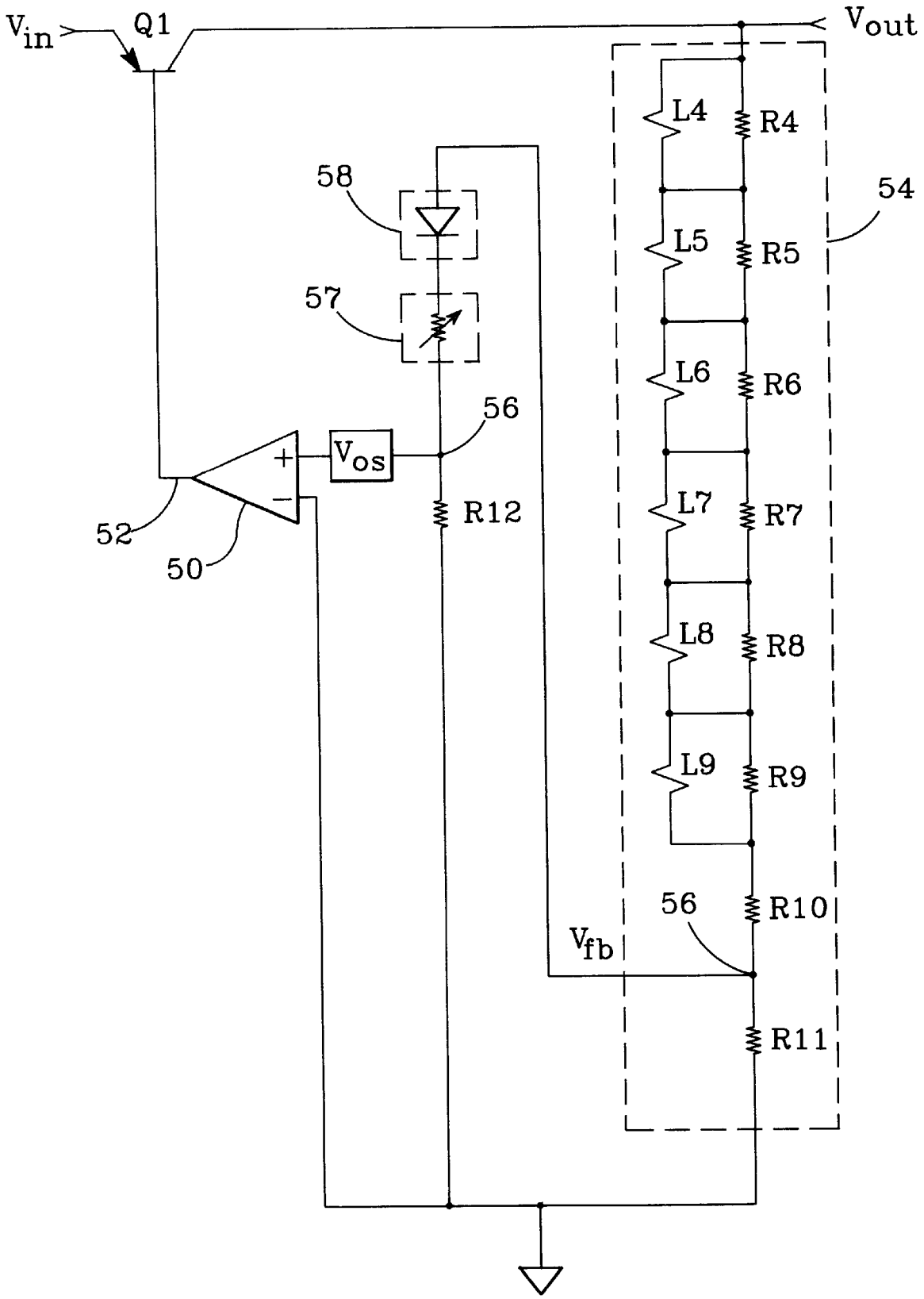
FIG. 3 is a schematic diagram of another embodiment of a series pass voltage regulator using a trimmable feedback network per the present invention.

Another embodiment of the trimmable voltage regulator feedback network is shown in the schematic diagram of FIG. 3. Feedback network 54 divides down the output voltage $V_{out}$ of a voltage regulator, producing a voltage $V_{fb}$ at its tap 56 which is eventually fed to an amplifier 50 which drives pass transistor Q1. Above tap 56 are seven series-connected resistors R4–R9, each of which has a respective severable link L4–L9 connected across it. A fixed resistor R10 is preferably connected in series between R4–R9 and tap 56, for reasons explained below. A fixed resistor R11 is connected between tap 56 and ground.

The feedback network configuration shown in FIG. 3 enables the regulator designer to select from a total of $2^n$ possible output voltages, with n equal to the number of resistors having severable links; here, n=6, and thus $2^6$=64 output voltages are possible. Severing no links produces the lowest $V_{out}$, while severing all the links produces the highest $V_{out}$. The values of fixed resistors R4–R11 can be arranged so that severing a given link results in a binary weighted change in $V_{out}$. For example, resistor values could be selected so that severing L4 increases $V_{out}$ by 50 mv, severing L5 increases $V_{out}$ by 100 mv, and so forth. Severing both L4 and L5 results in an increase in $V_{out}$ of 150 mv, because increments in $V_{out}$ accumulate linearly when this network structure is employed.

The resistive network in the feedback loop of a voltage regulator is typically advantageously used to produce an output voltage that is greater than the regulator's reference voltage. The presence of resistor R10 above tap 56, though not essential to the invention, insures that a significant resistance is present above the tap even if none of the links are severed; R10 thus forces $V_{out}$ to be greater than $V_{fb}$.

Though shown with six severable links in FIG. 3, the invention is not limited to any particular number of resistors and links. It is only essential that all of the severable links be located above the tap 56, and that there be a fixed resistance below the tap. To attain an output voltage $V_{out}$ which is trimmable in linearly independent increments requires the use of at least two links across respective resistors above the tap.

Equations 1–3 above assume the use of severable links having zero resistance. In practice, the severable links have a non-zero resistance, which must be taken into account when designing feedback network 54 to produce known increments in $V_{out}$. Voltage regulators such as that shown in FIG. 3 are typically fabricated as an integrated circuit, with the links typically formed in a ladder network made in the same manner as their respective fixed thin film resistors. As such, the unsevered resistance of each link can easily be 5–10 kΩ. The preferred links are severable with a laser, with the links needed to obtain a desired output voltage severed as a step in the regulator's fabrication process.

The network structure shown in FIG. 3 increases the range of resistances attainable at tap 56. The impedance of the network at the tap is given by the parallel combination of the total resistances above and below tap 56. Since all of the network's trimmability is employed above the tap, each severed link serves to increase the network's impedance. This wide range of possible network impedances may adversely affect the circuit being driven by feedback voltage $V_{fb}$. To compensate for this range of impedances, a trimmable resistance 57 is preferably connected in series with $V_{fb}$ to provide a means to normalize the network impedance. The trimmable resistance 57 is preferably one or more laser-trimmable resistors; preferably, the resistors are trimmed and the links severed at the same step of the fabrication process. The output voltage is typically monitored while resistance 57 is trimmed, and the trimming stopped as the desired output voltage is reached.

The invention is useful in regulators such as that shown in FIG. 2, in which an equilibrium point is reached when the feedback voltage is equal to a reference voltage which is explicitly found in the circuit. The feedback network's trimmability makes it possible for the feedback voltage to equal the reference voltage over a range of desired output voltages. In many regulator designs, a temperature-compensated output voltage is generated by basing the reference voltage on the bandgap voltage of silicon; in these regulators, the trimmable feedback network makes it possible to provide a range of temperature-compensated output voltages.

The ability to trim the feedback network's impedance is particularly important in a voltage regulator employing a "virtual reference", in which the reference voltage does not explicitly appear at any node in the regulator circuit. The regulator of FIG. 3 is such a regulator. Amplifier 50 is a transconductance amplifier having an intentional input offset voltage $V_{OS}$, designed to generate a proportional-to-absolute-temperature (PTAT) voltage at a node 56. The feedback voltage $V_{fb}$ produced by network 54 is connected to a p-n junction device 58 such as a diode or a diode-connected transistor, and a complementary-to-absolute-temperature (CTAT) voltage appears across the junction when forward-biased. The PTAT and CTAT voltages combine to create a temperature invariant reference when the circuit is at equilibrium.

A trimmable resistor 57 is connected between the junction 58 and PTAT node 56, to accommodate manufacturing variations in the forward voltage drop across the junction and various small error sources. Use of trimmable resistor 57 in series with the network feedback voltage $V_{fb}$ permits the temperature coefficient of junction 58 to be compensated for each possible configuration of severable links L4–L9, and thus for each possible output voltage.

The virtual reference in the regulator of FIG. 3 is the bandgap voltage, though the bandgap voltage does not appear explicitly at any node in the circuit; this circuit is thus referred to as a "virtual bandgap" circuit. The feedback network's usefulness is not limited to the virtual bandgap case, however—it can also be advantageously used in regulators using other types of virtual references which require compensation, as well as in regulators based on uncompensated references.

Figure 4:
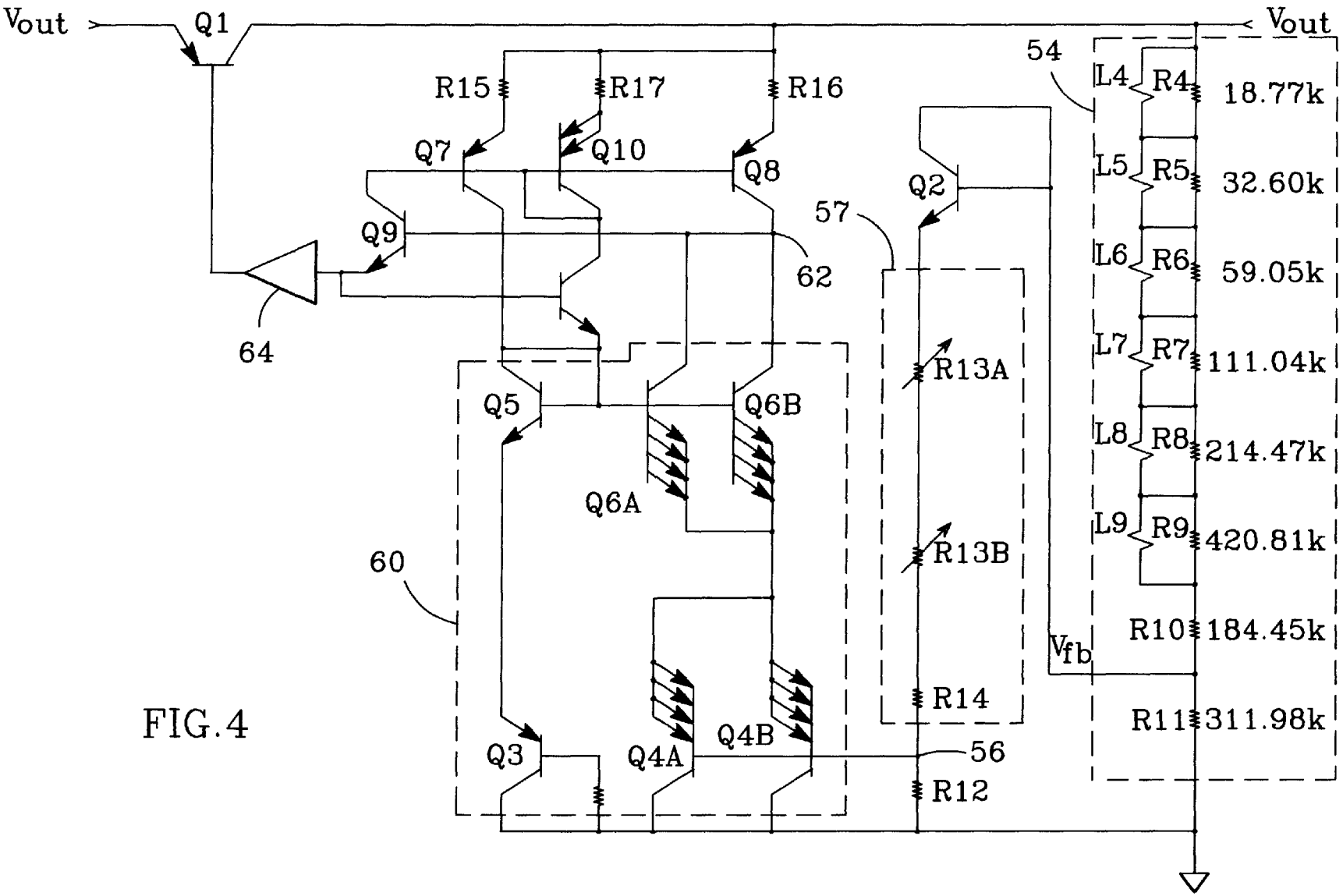
FIG. 4 is a schematic diagram of another embodiment of a series pass voltage regulator arranged to produce a temperature-compensated output voltage and using a trimmable feedback network per the present invention.

An embodiment of a voltage regulator employing the virtual bandgap principle and the trimmable feedback network is shown in the schematic diagram of FIG. 4. The p-n junction device 58 in FIG. 3 is here implemented with a diode-connected bipolar transistor Q2, and the trimmable resistance 57 is implemented with series-connected resistors R13A, R13B and R14. R13A is preferably fabricated as a continuous tab trim resistor, and R13B as a ladder-style link trim resistor. R14 is preferably a diffused resistor used for temperature coefficient curvature correction. R12 sets the PTAT current in R13A, R13B, R14 and Q2 when the feedback loop drives $V_{out}$ to maintain a PTAT voltage at node 56.

A loop amplifier 60 includes an input stage made from bipolar transistors Q3, Q4A and Q4B, and a gain stage made from bipolar transistors Q5, Q6A and Q6B. A pair of matched transistors Q7 and Q8, degenerated with resistors R15 and R16, respectively, are connected between $V_{out}$ and the gain stage. Q7 and Q8 cause transistors Q3, Q4A, Q4B, Q5, Q6A and Q6B to operate at approximately equal currents. Q4A, Q4B, Q6A and Q6B are each multiple-emitter devices, and therefore operate at a lower current densities that do Q3 and Q5. This current density difference creates the PTAT voltage at node 56 when the circuit is in equilibrium. The amplifier's output appear at a node 62, which is connected to drive a follower transistor Q9. Q9 drives a non-inverting amplifier 64 that generates a drive signal to the base of pass transistor Q1.

A fraction of the current generated by Q7 is diverted to provide base drive to Q5 and Q6, and a fraction of Q8's current provides Q9's base drive. To insure that the remainder of the Q7 and Q8 currents remain about equal, the collector current of follower Q9 is mirrored by way of a transistor Q10 (degenerated with a resistor R17) to the Q7 and Q8 currents. Load currents provided by Q9 affect its base current, but the currents in Q3 and Q4 mirror the load current change, so their base currents track that of Q9.

The voltage at node 62 moves up and down in response to very small changes in the voltage at node 56, so that if node 56 begins to depart from the desired PTAT voltage, the much larger change in voltage at node 62 changes the voltage applied to non-inverting amplifier 64. This changes the drive to pass transistor Q1 in such a direction as to oppose further change in the node 56 voltage.

To illustrate the benefits of feedback network 54, values are given in FIG. 4 for the network's fixed resistors. Six severable links L4–L9 provide $2^6$=64 possible output voltages; a table is shown in FIG. 5 that gives the approximate regulator output voltage $V_{out}$ for all 64 possible configuration of links L4–L9, from all links intact to all links severed. The output voltages assume a feedback voltage $V_{fb}$ of about 1.21 volts, and a typical link resistance of about 8.59 kΩ. As can be seen from FIG. 5, any one of 64 output voltages can be selected by severing the appropriate links, ranging from 2.1 volts to 5.25 volts in steps of about 50 mv. The fixed resistor values have been chosen so that severing the links results in binary weighted changes in output voltage: severing L4 increases output voltage $V_{out}$ by about 50 mv, L5 increases $V_{out}$ by about 100 mv, L6: 200 mv, L7: 400 mv, L8: 800 mv, and L9 increases $V_{out}$ by about 1600 mv. Because a feedback network per the present invention allows the output voltage increments to accumulate linearly, determining which links to sever in order to produce a desired $V_{out}$ is now a very straightforward process.

Referring back to FIG. 4, the trimmable resistance 57 allows the voltage at node 56 to be multiplied by the proper amount to temperature compensate each of the possible output voltages. The virtual bandgap principle insures that as the R13A and R13B combination are trimmed, the output temperature coefficient moves to zero as the output voltage is trimmed to the value corresponding to the links cut.

The arrangement of components and component values shown in FIG. 4 is merely illustrative. The network need not be arranged to produce binary weighted output voltage increments, nor is the network required to be used in a regulator utilizing a virtual reference principle. The invention merely requires that the feedback network be used in the control loop of a voltage regulator and configured with all severable links above the tap, permitting regulator output voltage increments to accumulate linearly with each severed link.

While particular embodiments of the invention have been shown and described, numerous variations and alternate embodiments will occur to those skilled in the art. Accordingly, it is intended that the invention be limited only in terms of the appended claims.

I claim:

1. A trimmable feedback network suitable for use with a voltage regulator which produces an output voltage that varies with a feedback voltage derived from said output voltage, said trimmable feedback network comprising:

at least two series-connected resistors connected between an output node and a feedback node, at least two severable links, each of said links connected across a respective one of said series-connected resistors, all of said network's severable links being across resistors connected between said feedback node and said output node, and a fixed resistance connected between said feedback node and a fixed voltage, said network producing a feedback voltage at said feedback node when said output node is connected to said output voltage which varies in accordance with the status of said severable links, each of said links producing a respective known increment in said output voltage when severed such that the total increase in said output voltage caused by severing links is equal to the linear accumulation of said severed link's respective known increments.

2. The feedback network of claim 1, wherein the values of said series-connected resistors and said fixed resistance are arranged such that each severed link increases said output voltage by a binary weighted increment.

3. The feedback network of claim 1, further comprising at least one trimmable resistor connected in series with said feedback node for adjusting the impedance of said network seen by said regulator.

4. A voltage regulator having a trimmable output voltage, comprising:

an output voltage terminal, a feedback input terminal, said regulator arranged to produce an output voltage at said output voltage terminal in accordance with a feedback voltage received at said feedback input terminal, and a trimmable feedback network, comprising:

at least two series-connected resistors connected between said output voltage terminal and said feedback input terminal, at least two severable links, each of said links connected across a respective one of said series-connected resistors, all of said network's links being across resistors connected between said feedback input terminal and said output voltage terminal, and a fixed resistance connected between said feedback input terminal and a fixed voltage, said output voltage selectable in accordance with the status of said severable links, each of said links producing a respective known increment in said output voltage when severed such that the total increase in said output voltage caused by severing links is equal to the linear accumulation of said severed link's respective known increments.

5. The voltage regulator of claim 4, wherein said output voltage is based on a reference voltage and the links of said feedback network are configured to produce a feedback voltage which is about equal to said reference voltage when said regulator output voltage is at a desired value.

6. The voltage regulator of claim 5, wherein said reference voltage is based on the bandgap voltage of silicon.

7. The voltage regulator of claim 4, wherein said series-connected resistors and said fixed resistance are arranged such that each severed link increases said output voltage by a binary weighted increment.

8. The voltage regulator of claim 4, wherein said regulator and feedback network are integrated together on a common substrate.

9. The voltage regulator of claim 8, wherein said severable links are arranged to be severed with a laser.

10. The voltage regulator of claim 4, further comprising at least one trimmable resistance connected between said network and said feedback input node for adjusting the impedance of said network seen by said regulator.

11. The voltage regulator of claim 10, wherein said output voltage is based on the bandgap voltage of silicon and said at least one trimmable resistance is trimmed such that the temperature coefficient of said output voltage is about zero when said output voltage is set to a desired value with said feedback network.

12. The voltage regulator of claim 10, wherein said regulator, feedback network and trimmable resistance are integrated together on a common substrate.

13. The voltage regulator of claim 12, wherein said trimmable resistance is arranged to be trimmed with a laser.

14. The voltage regulator of claim 4, further comprising a resistance connected between said series-connected resistors and said feedback input terminal to force said output voltage to be greater than said feedback voltage.

15. The voltage regulator of claim 4, wherein said fixed voltage is ground.

16. The voltage regulator of claim 4, wherein said feedback network comprises N series-connected resistors connected between said output voltage terminal and said feedback input terminal such that the output voltage of said regulator is trimmable to one of $2^N$ voltages, said output voltage increasing with the number of said links which are severed.

17. The voltage regulator of claim 4, wherein said regulator output voltage is based on a reference voltage not found at any node within the regulator, said feedback network arranged to produce a feedback voltage necessary to temperature compensate said regulator output voltage when said output voltage is at a desired value.

18. The voltage regulator of claim 17, wherein said reference voltage is the bandgap voltage of silicon.

19. A voltage regulator with a trimmable output voltage, comprising:

an output voltage terminal, a feedback input terminal, a trimmable feedback network, comprising:

at least two series-connected resistors connected between said output voltage terminal and said feedback input terminal, at least two severable links, each of said links connected across a respective one of said series-connected resistors, all of said network's links being across resistors connected between said feedback input terminal and said output voltage terminal, and a resistor connected between said feedback input terminal and a fixed voltage, a loop amplifier, comprising:

an input stage comprising bipolar transistors having unequal emitter areas and connected to receive an input voltage at an amplifier input node, and a gain stage comprising bipolar transistors having unequal emitter areas, said transistors operated at approximately equal currents to create a current density difference and thereby a proportional-to-absolute-temperature (PTAT) voltage at said amplifier input node, said amplifier arranged to cause a regulator output voltage to appear at said output voltage terminal in accordance with said input voltage received at said amplifier input node, and a p-n junction device connected between said feedback input node and said amplifier input node and generating a complementary-to-absolute-temperature (CTAT) voltage when forward-biased, said regulator output voltage selectable in accordance with the status of said severable links, each of said links producing a respective known increment in said output voltage when severed such that the total increase in said output voltage caused by severing links is equal to the linear accumulation of said severed link's respective known increments, said trimmable network enabling the generation of the PTAT voltage necessary to compensate the temperature coefficient of said p-n junction device for all selectable regulator output voltages.

20. The voltage regulator of claim 19, wherein said p-n junction device is a diode-connected bipolar transistor.

21. The voltage regulator of claim 19, further comprising a trimmable resistance connected between said p-n junction device and said amplifier input node for adjusting the impedance of said network.

22. The voltage regulator of claim 19, further comprising a pass transistor which produces said regulator output voltage in accordance with a drive signal received at a control input and an non-inverting amplifier connected to receive an output from said loop amplifier and to produce an output connected to generate said drive signal to said pass transistor.

23. The voltage regulator of claim 19, wherein said loop amplifier comprises:

an input stage comprising first and second bipolar transistors having unequal emitter areas, said first transistor's base connected to receive an input voltage at an amplifier input node and said second transistors's base connected to a fixed voltage, and a gain stage comprising a third and fourth bipolar transistors having unequal emitter areas connected in series with said first and second bipolar transistors, respectively, said first, second, third and fourth transistors operated at approximately equal currents to create a current density difference and thereby a PTAT voltage at said amplifier input node.

* * * * *